United States Patent [19]

Schmid

[11] Patent Number: 4,813,673

[45] Date of Patent: Mar. 21, 1989

[54] RAPID LOADING AND DISTRIBUTION APPARATUS FOR BOWLING PINS

[75] Inventor: August Schmid, Schwerzenbach, Switzerland

[73] Assignee: Patentverwertungs-und Finanzierungsgesellschaft Serania, Switzerland

[21] Appl. No.: 139,156

[22] Filed: Dec. 21, 1987

Related U.S. Application Data

[63] Continuation of Ser. No. 10,310, Feb. 3, 1987, abandoned.

[30] Foreign Application Priority Data

Feb. 10, 1986 [CH] Switzerland ..... 529/86

[51] Int. Cl.[4] ..... A63D 5/09

[52] U.S. Cl. ..... 273/43 D

[58] Field of Search ..... 273/43 R, 43 A, 43 D, 273/43 E

[56] References Cited

U.S. PATENT DOCUMENTS

| | | | |
|---|---|---|---|
| 2,671,549 | 3/1954 | Lubetkin | 273/43 R UX |
| 2,676,016 | 4/1954 | Whipple et al. | 273/43 A |
| 2,786,679 | 3/1957 | Strauss et al. | 273/43 R |
| 3,807,732 | 4/1974 | Congelli | 273/43 E |
| 3,809,398 | 5/1974 | Schmid et al. | 273/43 A |
| 3,810,617 | 5/1974 | Schmid et al. | 273/43 D |
| 3,966,206 | 6/1976 | Schmid | 273/43 E |

*Primary Examiner*—Anton O. Oechsle

*Attorney, Agent, or Firm*—Wood, Dalton, Phillips, Mason & Rowe

[57] ABSTRACT

To reduce the distribution time of bowling pins being fed horizontally along transport paths, first and central transport systems (41, 42) are located in a median portion of an elongated frame, with first and second connecting transport systems (43, 47), diverging from the central transport system, transport the bowling pins to peripheral transport systems (68, 69) located parallel and on either side of the first and second central transport systems. Bowling pins are distributed, alternately, to the first and second central transport system to be transported past pin receiving pockets to receive pins, provided the pockets are empty. The distribution apparatus is simple and formed witha Y-shaped distribution rocker to alternately cover or free pin supply chutes (5, 6) in alignment with the first and second transport systems, respectively.

16 Claims, 2 Drawing Sheets

RAPID LOADING AND DISTRIBUTION APPARATUS FOR BOWLING PINS

This application is a continuation of application Ser. No. 010,310, filed Feb. 3, 1987, abandoned.

Reference to related patents, the disclosure of which is hereby incorporated by reference, assigned to the assignee of this application:

U.S. Pat. No. 3,810,617, May 14, 1974, Schmid and Goens

U.S. Pat. No. 3,809,398, May 7, 1974, Schmid and Goens

U.S. Pat. No. 3,966,206, June 29, 1976, Schmid.

The present invention relates to bowling pin setting or pin spotting apparatus, and more particularly to an apparatus to provide for rapid loading and distribution of bowling pins on a set-up frame, and especially to an improvement over the earlier U.S. Pat. No. 3,810,617, assigned to the assignee of the present application and the disclosure of which is hereby incorporated by reference, to accelerate the distribution and placement of bowling pins on the set-up frame.

BACKGROUND

The earlier U.S. Pat. No. 3,810,617, of which the present inventor Schmid is a co-inventor, describes a bowling pin distribution apparatus in which bowling pins are conveyed consecutively in an essentially horizontal plane along a common path. Loading bins are located adjacent the path, each one for reception of a pin in a pin spotting position. The pins are conveyed along the path for transfer into the first available empty for free bin. The conveyors, preferably, are rubber ropes or belts. Deflectors—which are electrically controllably operated—deflect pins laterally into an empty bin, if a pin is to be loaded therein.

The frame carrying the loading bins and the distribution or transport ropes is supported on a suitable support mechanism. The bowling pins are free, that is, they are not suspended on ropes or chains at their heads. The pins, after having been set in an alley, and for example after a game has been played, are transported to a transport and elevator mechanism, in accordance with any suitable structure, lifted, and then supplied to the distribution apparatus which is described in detail in the aforementioned U.S. Pat. No. 3,810,617. The bowling pins are transported horizontally along a common zigzag transport path which passes along the reception bins for the respective bowling pins. Deflection apparatus deflect the pins in the first empty reception bin. A rocker element is located beneath the reception bins, gripping the respective pins and tipping them from horizontal into vertical position, for subsequent replacement on the bowling alley. The rockers are located in or connected to the vertically movable frame. The pins, after having been suitably aligned in accordance with the game to be played, and tipped into vertical position, are then lowered together with the frame, set on the bowling alley, and then released.

Bowling pin spotting apparatus of this type has been found eminently suitable and reliable, and has substantial advantages with respect to other apparatus. In some games, using for example ten pins, it may happen that only a few pins have been knocked over by a bowling ball. If such a game has been played, it has been found that a substantial time is required until the last replaced bowling pin reaches an empty bin, due to the requirement to transport pins to empty bins.

THE INVENTION

It is an object to reduce the time required to distribute bowling pins in an apparatus of the type described in the referenced U.S. Pat. No. 3,810,617, so that the time for a cycle of retrieving pins after a game has been played to resetting the pins can be reduced.

Briefly, the transport arrangement comprises a first and second central bowling pin transport system, secured to the frame, extending parallel to each other and longitudinally of the frame. The central transport systems are located in a median portion of the frame. Both of the transport systems operate in a first direction of transport movement. First and second peripheral bowling pin transport systems are provided, secured to the frame, and extending longitudinally thereof, located at respective peripheral portions and adjacent the central bowling bin portion. Both the peripheral transport systems operate, each, in a second direction of transport movement which is counter to the first direction of transport movement. First and second connecting pin transport systems provide for transport of bowling pins from the central systems to the peripheral systems, the connecting transport systems being located at the end portion of the respective central systems and direct bowling pins in an inclined, divergent movement between the respective central and peripheral systems. The connecting transport systems operate in the same direction of movement, but divergent, as said first transport direction. A distribution apparatus receives bowling pins from an elevator or other pin directing structure, in accordance with the particular installation in a bowling pin, as is well known and of any suitable construction, and, in accordance with a feature of the invention, distributes the arriving bowling pins, alternately, to the respective first and second transport systems, preferably the central transport system. Bowling pin receiving pockets or bins which, individually, may be constructed as described in the referenced U.S. Pat. No. 3,810,617, are adjacent to each of the first and second central and peripheral transport systems.

The arrangement has the advantage that two parallel pin transport systems are provided which permit substantial shortening of the transport path of any pin from the reception point to a respectively open bin or pocket. Usually, the bowling pins arrive at a much faster rate than they can be distributed, in horizontal position, by the transport systems and, based on this realization, the distribution apparatus distributes the arriving bowling pins between the parallel transport systems for rapid placement in any available bin or pocket. This substantially reduces the time for distribution of bowling pins in the respective pockets or bins, and thus the time of the operating cycle of the entire pin setting or pin spotting apparatus.

DRAWINGS

FIG. 1 is a top view of the distribution apparatus in accordance with the present invention; and FIG. 2 is a side view of the distribution apparatus to distribute arriving bowling pins, alternately, to the respective transport systems;

DETAILED DESCRIPTION

The pin spotting or pin placement apparatus for bowling pins will be described in connection with a typical "bowling" game, in which ten bowling pins, after a ball has been played, are raised by an elevator frame, and are then placed, in equally directed, aligned position, in a bowling pin distribution apparatus, to which they are supplied, in single pin position. Apparatus of this type is described in the referenced U.S. Pat. No. 3,966,206, by the inventor hereof, entitled "Bowling Pin Alignment Apparatus to Uniformly Align Bowling Pins End-for-End", the disclosure of which is hereby incorporated by reference. This bowling pin distribution apparatus places bowling pins in reception pockets associated with any bin position, as described in detail in U.S. Pat. No. 3,809,398, of which the present inventor is a co-inventor, entitled "Method and Apparatus for Automatic Bowling Pin Setting", the disclosure of which is hereby incorporated by reference. The bowling pins, in accordance with this disclosure, are placed in respective baskets, pockets, or bins, each adapted to hold a bowling pin. The baskets, pockets or bins are so distributed that, after the pins have been tipped into vertical position, flaps are arranged to release the pins so that they can be placed, in vertically standing alignment in the appropriate position for the game to be played.

As described in the referenced U.S. Pat. No. 3,810,617, entitled "Bowling Pin Loading Apparatus and Method", of which the present inventor is a co-inventor, and the disclosure of which is hereby incorporated by reference, a frame 10 is provided which is movable vertically. This frame, with respect to the transport apparatus, is stationary—although vertically movable for placement of pins—and, for the purpose of the present invention, will be referred to as a "stationary" frame although it is to be understood that it can be moved with the bowling pins to place them in appropriate position.

Figure 1:
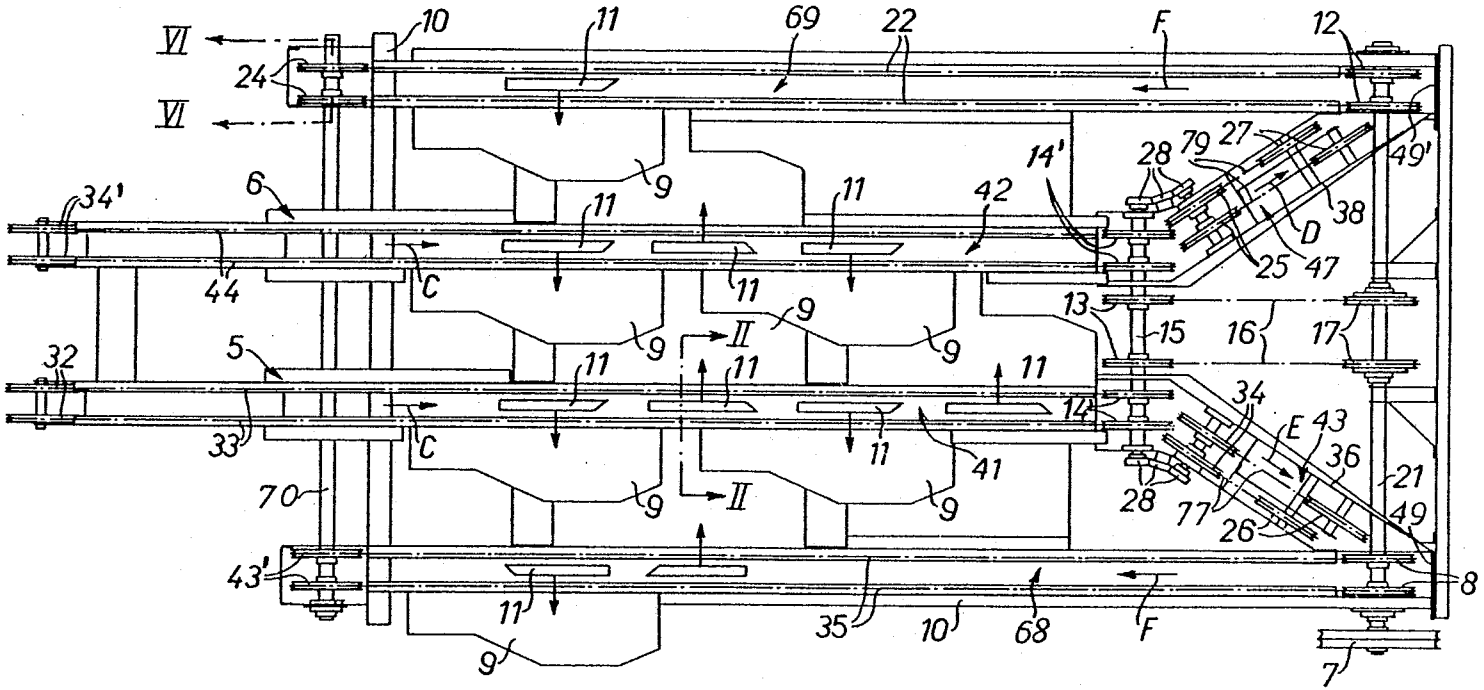
Figure 2:
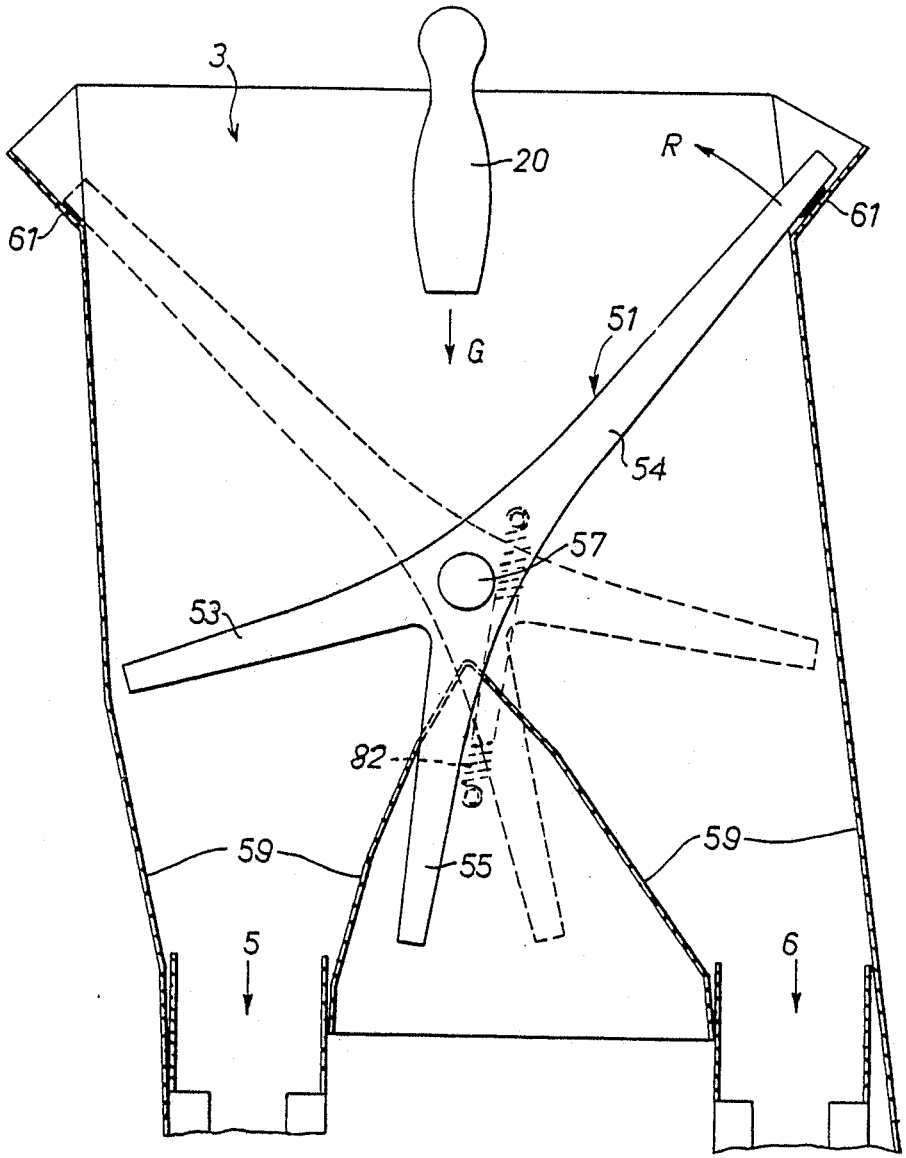

The frame 10 has a group of driven belts or rubber ropes, looped about appropriately placed driven pulleys, which provide for transport of bowling pins supplied to the belts or rubber ropes. Two spaced belts or rubber ropes, spaced from each other and looped about the appropriate pulleys, provide for transport of bowling pins thereon in horizontal position. The bowling pins 20 (FIG. 2) are transported in horizontally flat position on the belts, as best seen in FIGS. 1 and 2 of the referenced U.S. Pat. No. 3,810,617. The belts transport the bowling pins 20 along a transport path which includes deflection fingers 11. The deflection fingers 11, depending on their position, either deflect a pin into an empty reception basket, pocket or bin 9 or, if the pocket, basket or bin should be filled, permit the transported bowling pin to move to the next deflection finger 11, to be placed into the next basket, pocket or bin, if it should be empty, and so on.

In accordance with the present invention, two parallel transport systems are located on the frame 10 for delivering pins in the first and second paths. One transport system is formed by a pair of parallel belts or rubber ropes 33 (FIG. 1), and another is formed by a pair of parallel belts or rubber ropes 44. Preferably, the belts or ropes have a circular cross section. The belts or ropes 33 form a first central transport system, together with suitable deflection pulleys which, preferably, are driven. Thus, one end of the belts 33 is looped about pulleys 32, and the other end about pulleys 14. For better consideration of FIG. 2, the belts 33 are shown only schematically in FIG. 1, that is, shown only by their longitudinal center line in chain-dotted representation. Similarly, the belts 44 of the second central transport system 42 are looped about end pulleys 34' and 19. The pulleys 14, 19 are driven via a shaft 15, to which they are secured. Shaft 15 additionally holds pulleys 13 which, in turn, are driven by pulleys 17 through means 16. Pulleys 17 are secured to a shaft 21 from where they are driven by a main drive wheel 7.

Two short divergent first and second transport systems 43, 47 are located, as shown preferably within the frame, to transport pins to peripheral first and second transport systems 68, 69. The first and second divergent transport systems 43, 47 are preferably inclined in divergent direction such that they form, with the center line of the respective first and second central transport systems, angles of between about 15° to 20°; these angles are not critical and can be varied to suit the arrangement and size of the frame. Bowling pins 20, supplied for example by the belt pair 33, are deflected by deflection sheets 36 in the direction of the arrow E and then received by belts 77, which are looped about pulleys 26 and 34. Similarly, bowling pins 20 which are transported over the belt pair 44, are deflected in the direction of the arrow D, and are then received by the belts or rubber ropes 79 which are looped about pulleys 25 and 27. Deflection sheets 38 assist in deflection of the bowling pins being transported.

The pulleys 25, 34 are driven by angle gears 28, coupled to the shaft 15, in any suitable drive arrangement. The two pulleys 26, 27 are located in staggered position in order to facilitate transition of the bowling pins to the peripheral transport system 68, 69 having, respectively, belt or rubber rope pairs 22, 35. The belts 22 of the peripheral transport system 69 are looped about drive pulleys 12 and 24 and transport a bowling pin in the direction of the arrow F. The belts 35 of the peripheral transport system 68 are looped about pulleys 8 and 43', and move the bowling pins likewise in the direction of the arrow F. The pulleys 24, 43' are interconnected by shaft 70. At the transition of the connection divergent transport system 43 with the transport system 68, the bowling pins engage against an abutment plate 49 which, also, deflects the bowling pins to the peripheral transport systems 68, that is, on the belts 35. Analogously, transition of bowling pins from the connecting transport system 47 to the transport system 69 is facilitated by an abutment plate 49'. The bowling pins preferably are transported on the central systems 41, 42 with the foot or base portion first, so that the impingement of the bowling pins 20 against the abutment plate 49 is with the foot or base portion of the pins.

In accordance with a feature of the invention, the bowling pins are directed, alternately, to the central transport systems 41, 42 by a distribution apparatus 3 which is simple, reliable and effective, and illustrated in FIG. 2, to which reference is now made.

The bowling pins 20, raised by an elevator mechanism and distributed to an inlet funnel or inlet zone of the distribution system—in accordance with any suitable apparatus and, for example, as described in the referenced U.S. Pat. No. 3,966,206, are dropped in the direction shown by arrow G—FIG. 2—on a distribution rocker 51. The distribution rocker 51 directs the pins 20, foot or base portion first or downwardly in either one of an adjacent distribution duct or channel 5 or 6. The channels 5 or 6 are aligned with the respective central transport systems 41, 42—see FIG. 1—and may terminate in a chute which places the bowling pins, base or foot portion forward, on the respective central transport systems 41, 42. The respective chute or duct 5, 6 thus places the pins 20 alternately on the central transport systems, 41, 42, having the respective pairs of transport belts 33, 44, for subsequent transport—foot or base forward—in the direction of the arrow C (FIG. 2).

The distribution apparatus 3 includes a distribution rocker 51 which, as best seen in FIG. 2, is of approximate Y shape positioned inversely in the distribution apparatus and rotatable about an axis or shaft 57. Shaft 57 is located horizontally, and so placed that the Y rocker can be moved and positioned from the full-line position in FIG. 2 to the broken-line position, and vice versa. The arms 53, 55 of the distribution rocker 51 form with each other an angle of between about 50° to 70°. Guide vanes or guide sheets, typically of sheet metal, plastic or the like, are provided, as seen at 59 in FIG. 2, to guide the respective bowling pins 20 into the chutes or ducts 5, 6, respectively, as determined by the position of the distribution rocker 51. In the end positions of the distribution rocker 51 which are shown, respectively, in full-line and broken-line respresentation in FIG. 2, the respective arms 53, 55 cover the inlet of the respective duct or chute 5, 6 which is to receive the pin 20. The inlet is opened only by tipping of the distribution rocker 51 when a bowling pin 20, sliding down the concavely formed surfaces of the distribution rocker 51, tips the distribution rocker to open the entry to the respective chute. The two end positions of the distribution rocker 51 are determined by end stops 61, formed on the inlet chute or inlet duct, and preferably resiliently supporting the end positions of the distribution rocker 51, for example with a rubber cushion or the like, or otherwise by a resilient engagement. The distribution rocker 51, due to the weight of the arm 54, will rest in one of two terminal positions, shown in FIG. 2. If necessary, but not mandatory, an additional spring 82 can be used which, preferably, is coupled to a frame portion of the structure, associated with the frame 10, or otherwise retained on the outer frame of the inlet chute, and coupled to the rocker 51 so as to positively hold the rocker 51 and to be snapped from one over-center position to another, as well known in connection with toggle spring arrangements. The location of spring 82, and its connection to a fixed point and to the rocker 51 is shown in FIG. 2 which, as noted, is not, however, specifically required.

Operation

Let it be assumed that a bowling pin 20 is dropped on the distribution rocker 51, base or foot forward, in the direction of the arrow G. If the distribution rocker 51 is in the full-line position shown, the pin 20 will impinge on the arm 53, and due to its dynamic energy, as it drops, will move the distribution rocker from the full-line position into the broken-line position, by moving the rocker in the direction of the arrow R. This causes the pin 20 to slip or slide along the bent outer surface of the forked portion 53 of the rocker 51 and to be guided by the guide sheets or vanes 59 into the chute or duct 5. The rocker 51 will then remain in the broken-line position. The next pin 20 will impinge on the arm 55—now in the upper, broken-line position, and the pin 20 wil be directed into the chute 6. The central belt systems 41, 42, with the belt pairs 33, 44, respectively, are below the chutes or ducts 5, 6, the chutes 5, 6 directing the pins on the respective belt system.

Bowling pins, being transported on the central belt systems, are either deflected on the sequentially located reception pockets, baskets or bins 9 unless the pocket bin or basket already is occupied by a pin. The operation of the deflection fingers 11 and further handling of the bowling pins which are placed in the respective pockets, baskets or bins 9 is described in detail in the referenced U.S. Pat. No. 3,810,617. Any bowling pins which, throughout the entire transport path, do not meet an empty reception pocket, basket or bin, are ejected over the edge of the rollers 24, 43°, at the ends of the peripheral systems 68, 69 from where they can be directed by a slide, chute or the like into a pin collection pit or the like, for repetition of the distribution of bowling pins; alternatively, if all bins or pockets are occupied, a sensing switch mechanism can be operated to stop further supply of bowling pins for intermittently stopping distribution of pins to the transport systems.

The use of a pair of parallel arranged belt systems 33, 44, which are located in median portions of the frame 10 together with peripheral transport system pairs, permits substantially shortening of the transport path which any one pin must pass through, with respect to prior apparatus. Thus, the distribution time for the bowling pins is substantially decreased. The additional structural requirements, namely the distribution apparatus (FIG. 2), is simply, trouble-free, and does not require any external controls, so that it can be made inexpensively. The frame arrangement and the transport paths thereon are simple and, as can be seen from a comparison of FIG. 1 of the present application with FIG. 1 of the referenced U.S. Pat. No. 3,810,617, even simpler and thus eminently reliable.

Various changes and modifications may be made; for example, the bowling pins can first be guided to the peripheral transport systems although this would introduce some complexity in the shift-over of the pins to the central systems; thus, the arrangement as shown and described in detail is preferred.

Various other changes and modifications may be made within the scope of the inventive concept.

FIG. 1 shows section lines II—II and VI—VI; these section lines show structures at the respectively similarly numbered sections lines in FIGS. 2 and 6 of the referenced U.S. Pat. No. 3,810,617 and have been kept in FIG. 1 of the present application for ease of understanding and of association of the present application with the referenced U.S. Pat. No. 3,810,617.

I claim:

1. Rapid loading and distribution apparatus for bowling pins (20) having an elongated frame (10);

a plurality of pin receiving pockets, baskets or bins (9) secured to the frame, and comprising, in accordance with the invention, a first and a second central bowling pin transport system (41, 42), secured to the frame, extending essentially parallel to each other and longitudinally of the frame, and located in a median portion of the frame, both said central transports systems operating in a first direction (C) of transport movement;

a first and a second peripheral bowling pin transport system (68, 69), each secured to the frame, extending longitudinally of the frame and located, respectively, at peripheral portions thereof, both said peripheral transport systems operating, each, in a second direction (F) of transport movement which is counter said first direction of transport movemmt;

a first and a second connecting bowling pin transport system (43, 47) secured to the frame (10) each system extending from an end or terminal portion of the central transport system to an end or terminal portion of the peripheral transport systems, and being located in divergent directions to connect the respective central and peripheral first and second transport systems, both said connection transport systems operating, each, in a divergent direction with transport movement, essentially, in said first direction; and a distribution apparatus (51) receiving bowling pins (20) and distributing the bowling pins, alternately, to a respective first and second transport system (41, 42; 68, 69), and wherein said pin receiving pockets are located in positions adjacent each of the respective first and second central and peripheral transport systems.

2. The apparatus of claim 1, wherein the distribution apparatus includes first and second distribution ducts tor chutes (5, 6) located in alignment with, respectively, the first and second central bowling pin transport systems for alternately placing bowling pins on said respective transport systems.

3. The apparatus of claim 1, wherein said distribution apparatus is positioned for alternately distributing the bowling pins to the first and second central transport systems.

4. The apparatus of claim 1, wherein the distribution apparatus comprises a distribution rocker (51) pivotable about an essentially horizontal axis (57) and being formed in essentially Y-shaped configuration, with a single upwardly extending arm (54) and two fork arms (53, 55) located below said essentially horizontal axis (57), said distribution rocker (51) being tipped from a position, in which one fork arm (e.g. 53) covers a distribution duct (5) in alignment with one of said transport systems, by the weight of a bowling pin (20) impinging thereon into a position opening said one duct (5) and, thereby, causing the other fork arm (55) to cover another distribution duct (6), a subsequent bowling pin (20) then impinging on said other fork arm (55) to free the other distribution duct (6) and permit the bowling pin to slide in the other duct (6), and thus alternately directing bowling pins to the first and second transport systems, respectively.

5. The apparatus of claim 4, wherein said ducts or chutes (5, 6) are in alignment with, respectively, the first and second bowling pin transport systems (41, 42).

6. The apparatus of claim 4, wherein the distribution ducts or chutes (5) are so positioned with respect to the pivot axis (57) and the respective fork arms that the fork arms cover and close an inlet portion of the respective chute or duct (5, 6);

and wherein a central arm (54) of said distribution rocker (51) is positioned to receive bowling pins in a bowling pin inlet section.

7. The apparatus of claim 4, further includes a spring (82) retaining the distribution rocker (51) in a respective terminal position wherein the common rocker arm (51) is deflected to provide for an open entry for bowling pins in a receiving section of said distribution apparatus and the respective fork arms (53, 55), alternately, cover and release a respective one of said distribution ducts or chutes (5, 6), said spring means including an over-center spring to positively retain said distribution rocker in a respective terminal end position.

8. The apparatus of claim 7, including resilient stop means (61) located adjacent the terminal end positions of the common arm (54) of said distribution rocker (51) to provide for resilient, soft engagement of the rocker arm thereagainst.

9. The apparatus of claim 7, wherein said ducts or chutes (5, 6) are in alignment with, respectively, the first and second bowling pin transport systems (41, 42).

10. An apparatus for loading bowling pins (20) in a plurality of pockets (9) on a frame (10), said apparatus comprising:

first means (41, 68; 42, 69) for transporting bowling pins (20) in a first substantially horizontal path;

second means (41, 68; 42, 69) for transporting bowling pins (20) in a second substantially horizontal path;

means (51) for delivering bowling pins (20) from a supply directly to each of said first and second pin transporting means (41, 68; 42, 69);

means (11) for directing bowling pins (20) conveyed by the first transporting means (41, 68; 42, 69) out of the first path to at least one of the pockets (9) for placement of the pins on an alley; and means for directing bowling pins (20) conveyed by the second transporting means (41, 68; 42, 69) out of the second path to at least another one of the pockets (9) for placement of the pins on the same alley as the pins conveyed by the first transporting means (41, 68; 42, 69).

11. The bowling pin loading apparatus according to claim 10 wherein said delivering means (51) comprises means to distribute bowling pins (20) from the supply alternately to said first and second pin transporting means (41, 68; 42, 69).

12. An apparatus for loading bowling pins (20) in a plurality of pockets (9) on a frame (10), said apparatus comprising:

first means (41, 68; 42, 69) for transporting bowling pins (20) in a first path;

second means (41, 68; 42, 69) for transporting bowling pins (20) in a second path;

means (51) for delivering bowling pins (20) from a supply directly to each of said first and second pin transporting means (41, 41; 68, 69);

means (11) for directing bowling pins (20) conveyed by the first transporting means (41, 68; 42, 69) out of the first path to at least one of the pockets (9); and means for directing bowling pins (20) conveyed by the second transporting means (41, 68; 42, 69) out of the second path to at least another one of the pockets (9), wherein said frame (10) has first and second spaced ends and said pins (20) delivered to the first transporting means (41, 69; 42, 69) are conveyed thereby in the first path from the first frame end towards the second frame end and back towards the first frame end.

13. The bowling pin loading apparatus according to claim 12 wherein the pins (20) move in the first path linearly in a first direction from the first frame end towards the second frame end and linearly in a second direction opposite to the first direction from the second frame end towards the first frame end.

14. An apparatus for loading bowling pins (20) in a plurality of pockets (9) on a frame (10) having first and second spaced ends, said apparatus comprising:

first central transport means (41, 42) for conveying bowling pins (20) in a first substantially linear path from said first frame end to the second frame end;

second central transport means (41, 42) for conveying bowling pins (20) in a second substantially linear path from the first frame end to the second frame end;

first peripheral transport means (68, 69) for conveying bowling pins (20) from the first central transport means (41, 42) at the second frame end towards the first frame end;

second peripheral transport means (68, 69) for conveying bowling pins (20) from the second central transport means (41, 42) at the second frame end towards the first frame end;

means (51) for delivering bowling pins from a supply to both the first and second central transport means (41, 42); and means (11) for loading bowling pins (20) from the first and second central and peripheral transport means (41, 41; 68, 69) into the pockets (9).

15. The apparatus for loading bowling pins (20) according to claim 14 wherein connecting means (43, 47) are provided to direct pins (20) from the first central transport means (41, 42) to the first peripheral transport means (68, 69) and connecting means (43, 47) are provided to direct pins (20) from the second central transport means (41, 42) to the second peripheral transport means (68, 69).

16. The apparatus for loading bowling pins according to claim 14 wherein the delivering means (50) comprises means for distributing bowling pins (20) from the supply alternately to the first and second central pin transport means (41, 42).

* * * * *